US005927368A

United States Patent [19]

Rohrer et al.

[11] Patent Number: 5,927,368

[45] Date of Patent: Jul. 27, 1999

[54] OVERHEAD DOOR WITH A PANEL-CARRIER FRAME AND REPLACEABLE PANELS

[75] Inventors: Stephen R. Rohrer, Menomonee Falls; William B. Weishar, Brookfield, both of Wis.

[73] Assignee: HPD International, Inc., Sussex, Wis.

[21] Appl. No.: 08/978,558

[22] Filed: Nov. 26, 1997

[51] Int. Cl.[6] ..... E05D 15/16

[52] U.S. Cl. ..... 160/201

[58] Field of Search ..... 160/201, 229.1, 160/232, 40, 206, 207

[56] References Cited

U.S. PATENT DOCUMENTS

| | | | |
|---|---|---|---|
| 2,252,737 | 8/1941 | Siess | 160/201 X |
| 3,118,189 | 1/1964 | Dugger . | |
| 3,192,992 | 7/1965 | Hasselmark . | |
| 3,339,619 | 9/1967 | Crosswell | 160/40 |
| 3,648,755 | 3/1972 | Thiele | 160/40 X |
| 3,967,671 | 7/1976 | Stanley et al. | 160/201 X |
| 4,156,448 | 5/1979 | Bengtsson | 160/201 X |
| 4,320,793 | 3/1982 | Lindbergh . | |
| 4,452,293 | 6/1984 | Gorse | 160/232 |
| 4,924,932 | 5/1990 | Esnault | 160/201 |
| 4,957,301 | 9/1990 | Clay et al. | 160/40 X |
| 5,168,915 | 12/1992 | Lafleur | 160/201 X |
| 5,535,805 | 7/1996 | Kellogg et al. . | |
| 5,584,333 | 12/1996 | Torchetti et al. . | |
| 5,718,276 | 2/1998 | Rekret | 160/201 |

*Primary Examiner*—David M. Purol
*Attorney, Agent, or Firm*—Godfrey & Kahn, S.C.

[57] ABSTRACT

A plate for mounting a plunger on each panel is mounted on the inwardly facing surface of each end of each panel. One or more plungers are positioned on each plate and each plunger has a first end biased in a first position within the groove of the track.

24 Claims, 7 Drawing Sheets

OVERHEAD DOOR WITH A PANEL-CARRIER FRAME AND REPLACEABLE PANELS

FIELD OF THE INVENTION

The present invention relates to overhead doors. More specifically, the present invention relates to an overhead door that is designed with a frame that supports the panels of the door and may be fitted with assemblies so that it releases from its tracks when the door is impacted, thereby preventing damage to the door, tracks, and surrounding supporting structures.

BACKGROUND OF THE INVENTION

Overhead doors are used to occlude openings in structures such as warehouses, factories, and other commercial establishments. Doors are typically used at loading docks and are often subject to impacts from fork lifts, other loading devices, and freight. Such impacts often cause damage to an overhead door and sometimes to the building structure supporting the door. A variety of impact-resistant doors have been developed in response to this problem. For example, U.S. Pat. No. 5,584,333, issued to Torchetti et al., and U.S. Pat. No. 5,025,847, issued to Mueller, disclose assemblies designed to lessen the damage caused by an impact to a door.

While these and other prior-art devices have operated with some degree of success, they have several shortcomings. The impact resistant assemblies shown in U.S. Patent No. 5,025,847, while operable to release from an associated track upon being exposed to force of a predetermined magnitude, are relatively complex in their mechanical arrangement. Complex door designs, of course, greatly increase the cost of manufacturing and maintaining an overhead door. Further, the door design taught by U.S. Pat. No. 5,584,333, while useful for reducing the damage to a flexible, bottom panel, is not appropriate for all applications, particularly those where a door with relatively rigid panels is desired.

A further shortcoming with the various prior-art devices is the difficulty and sometimes impossibility of replacing panels in the doors after they have been damaged by an impact. Even in doors designed to lessen or reduce damage caused by impacts, door panels can become damaged to a point where they are inoperable. Typically, replacing a panel requires installing an entirely new door or completely releasing spring tension, disconnecting counterbalance cables, and panel hardware, and removing the door from its tracks in order to replace the damaged panel.

Another shortcoming with prior-art doors is that they are constructed from relatively costly materials. For example, the door shown in U.S. Pat. No. 5,535,805, issued to Kellogg et al., includes extruded plastic tracks which are made from a relatively expensive low-friction material. In addition, the panels used in the door are made from numerous parts and relatively expensive non-metallic materials, including polycarbonate and fiberglass. While these doors are robust, many customers can't afford and don't desire such an expensive, heavy-duty door.

Therefore, it would be desirable to have an improved overhead door designed so that its panels could be readily replaced without the need to remove the entire door from its tracks. Further, it would be desirable to have a door that releases from its tracks when exposed to a force of a predetermined magnitude in order to limit or prevent damage to the door, its track, and surrounding structure. Further, it would be desirable if the door had a simple design with relatively few components which could be manufactured from relatively inexpensive materials so as to reduce the overall cost of the door.

OBJECTS AND SUMMARY OF THE INVENTION

Therefore, it is an object of the present invention to provide an overhead door that includes a mechanism that permits replacement of the door's panels without the need to remove the entire door from its tracks.

Another object of the present invention is provide an overhead door that reliably releases door panels from their tracks when exposed to force of a predetermined magnitude without damaging the associated tracks or surrounding structures.

Another object of the present invention is to provide an overhead door of relatively simple design without wheels or rollers and which can be manufactured from relatively inexpensive materials so as to reduce the overall cost of the door.

Another object of the present invention is to provide an overhead door that is operable, in one form, to reliably release when force is applied to either side of the door.

Another object of the present invention is to provide an overhead door that includes a release assembly having a plunger that is biased into an engaged position relative to an associated track and, when exposed to force of a predetermined magnitude, is operable to move to a disengaged position to release the overhead door from the track and prevent damage to the overhead door and the associated track.

Another object of the present invention is to provide an overhead door assembly which can be quickly and easily placed back into operation following disengagement from the associated track assembly.

Another object of the present invention is to provide an overhead door assembly which has a rigid-panel construction, where the rigid panels have a light-weight-construction in relative comparison to prior-art assemblies.

These and other objects and advantages are achieved in an overhead door having two tracks. In use, one track is mounted on each side of an opening in a building and the tracks are positioned so as to be substantially parallel to one another. Each of them is a two-layer track having a first relatively low-friction layer and a second supporting layer. Preferably, the first layer is made from extruded plastic and the second layer is made from steel or another strong, relatively inexpensive material. Each two-layer track has a script-v shape in cross-section and a groove or channel that runs along its longitudinal axis.

A panel-carrier frame having a plurality of pivotally-linked segments is positioned between the two tracks. The segments are assembled to form two parallel supports which are aligned with the tracks. Each segment is L-shaped in cross-section and has a portion for being mounted to a plastic panel. One or more plastic panels, preferably one, are attached to each segment of the panel-carrier frame. Each panel has first and second ends and inwardly and outwardly facing surfaces. The outwardly facing surface of each end of each panel is attached to a single segment of the panel-carrier frame.

A plate or other means for mounting a plunger on each panel is mounted on the inwardly facing surface of each end of each panel. One or more plungers are positioned on each means for mounting a plunger and each plunger has a first end biased in a first position within the groove of the track. The plungers are designed to release from the track when the panel on which they are mounted is impacted. In an optional form of the present invention, the plungers take the form of a static pin. While the static pins do not release from the track on impact, they are less expensive than biased, dynamic plungers and may be used on all or one of the panels of the door in applications where release of the door panels is not critical.

One of the advantages of the present invention over conventional doors is that it operates without wheels or rollers. Typically, overhead doors operate with wheels or rollers which ride in C-shaped tracks. As can be appreciated, wheels and their associated bearing assemblies are relatively complex, expensive, and often require regular maintenance to operate properly. Using a plunger or pin which slides in a groove or channel eliminates the need for wheels or rollers. In addition to these features, the present invention includes a single-piece, solid weather strip coupled on each end of each panel. The weather strip is designed to be in contact with the first layer of the two-layer track and helps to create a weather-tight seal around the door panels.

These are just some of the features and advantages of the present invention. Many others will become apparent by reference to the detailed description of the invention taken in combination with the accompanying drawings.

DETAILED DESCRIPTION

Figure 1:
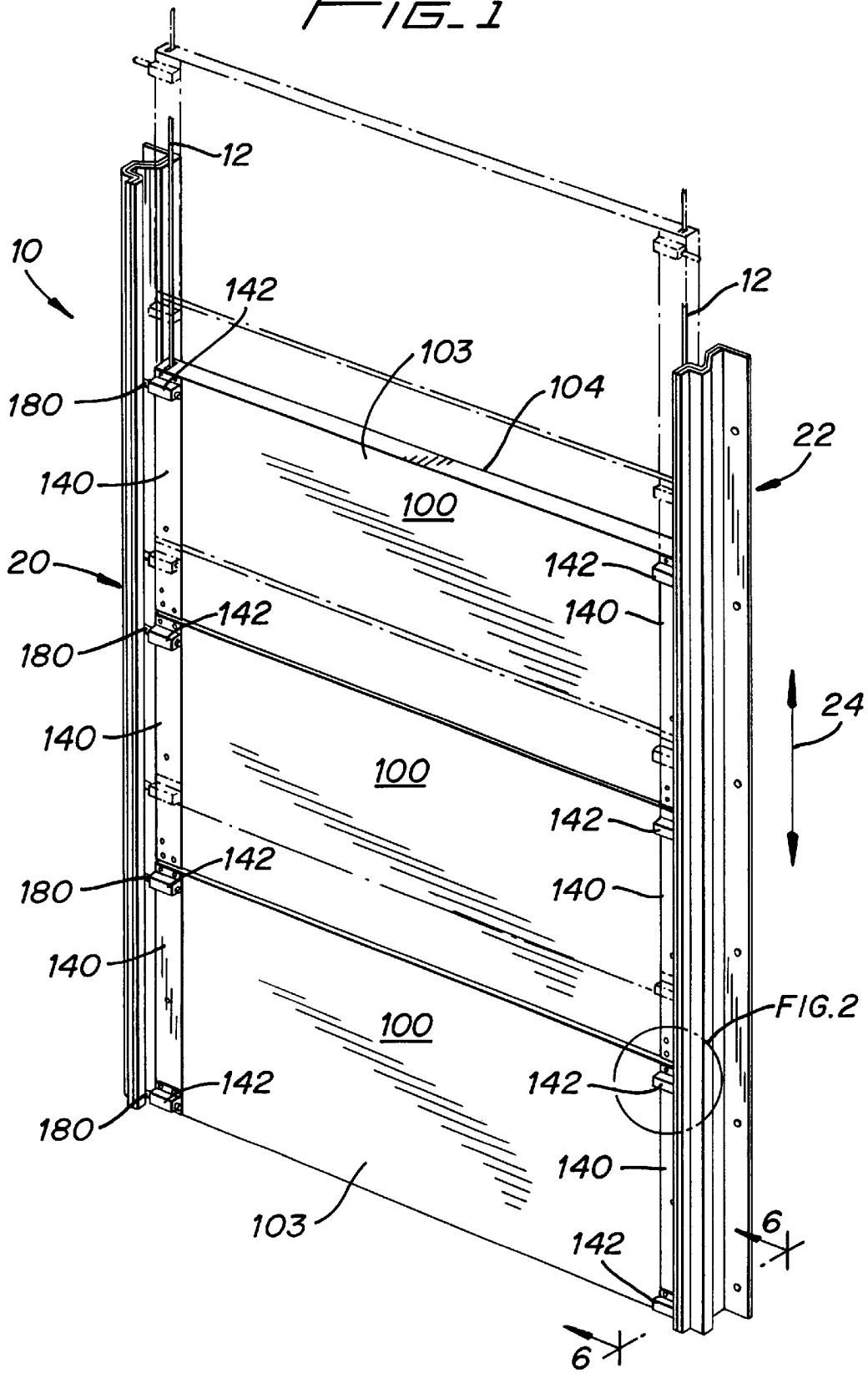
FIG. 1 is a perspective, environmental view of an overhead door of the present invention.

An overhead door 10 of the present invention is shown in FIG. 1. The overhead door 10 is designed to be installed in an opening (not shown) of a building (also not shown) and is particularly useful as a door for a loading dock, such as those found in warehouses, manufacturing facilities, and the like. Although not shown, the overhead door 10 is designed to be used with a torsion spring counterbalance or retraction assembly, of substantially conventional design, mounted in a predetermined position above the door. A spring assembly useful with the present invention may have an axle assembly, one or more of take-up pulleys, one or more torsion springs, and one or more cables 12 fastened to the take-up pulley and the overhead door 10 to lift or move the overhead door 10 into an open position, as shown in phantom lines in FIG. 1, or otherwise permit the overhead door 10 to be positioned at any desired location, thereby selectively occluding an opening in a building.

The overhead door 10 of the present invention acts in combination with a pair of tracks 20 and 22, each of which is substantially identical to one another and designed to be fastened on the wall 23 (FIG. 3) of a building. The tracks 20 and 22 are disposed in predetermined, substantially parallel spaced relation one to the other and define a predetermined path of travel 24 for the overhead door 10. While the path of travel 24 is shown as a substantially linear path the overhead door may follow a curved path of travel as where the door moves along the tracks into a position which is substantially parallel to the floor of the building. This type of installation would typically be utilized in buildings having relatively low interior ceilings.

Figure 3:
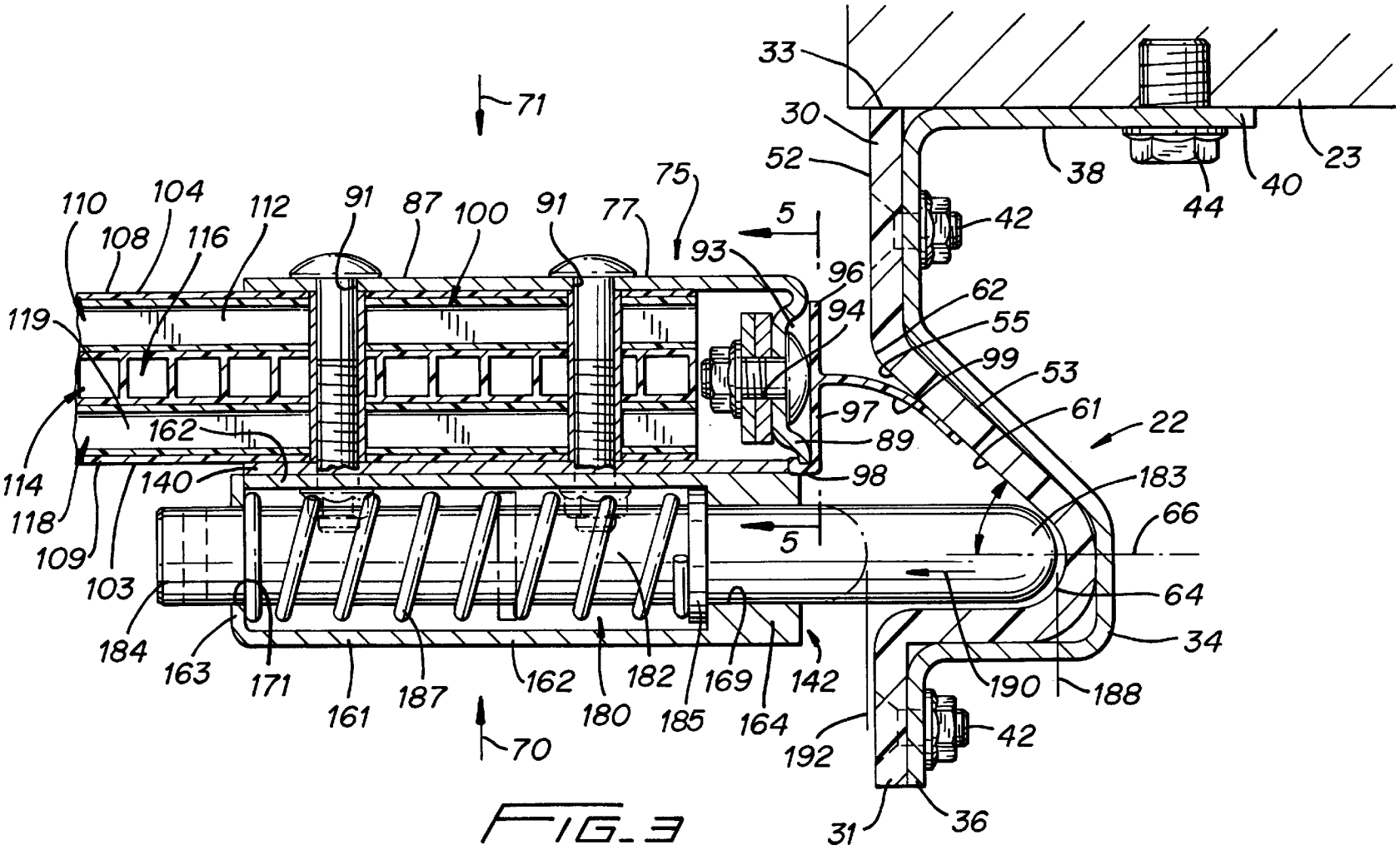
FIG. 3 is a cross-sectional view of a plunger and door panel used in the present invention along the line 3—3 of FIG. 2.
Figure 7:
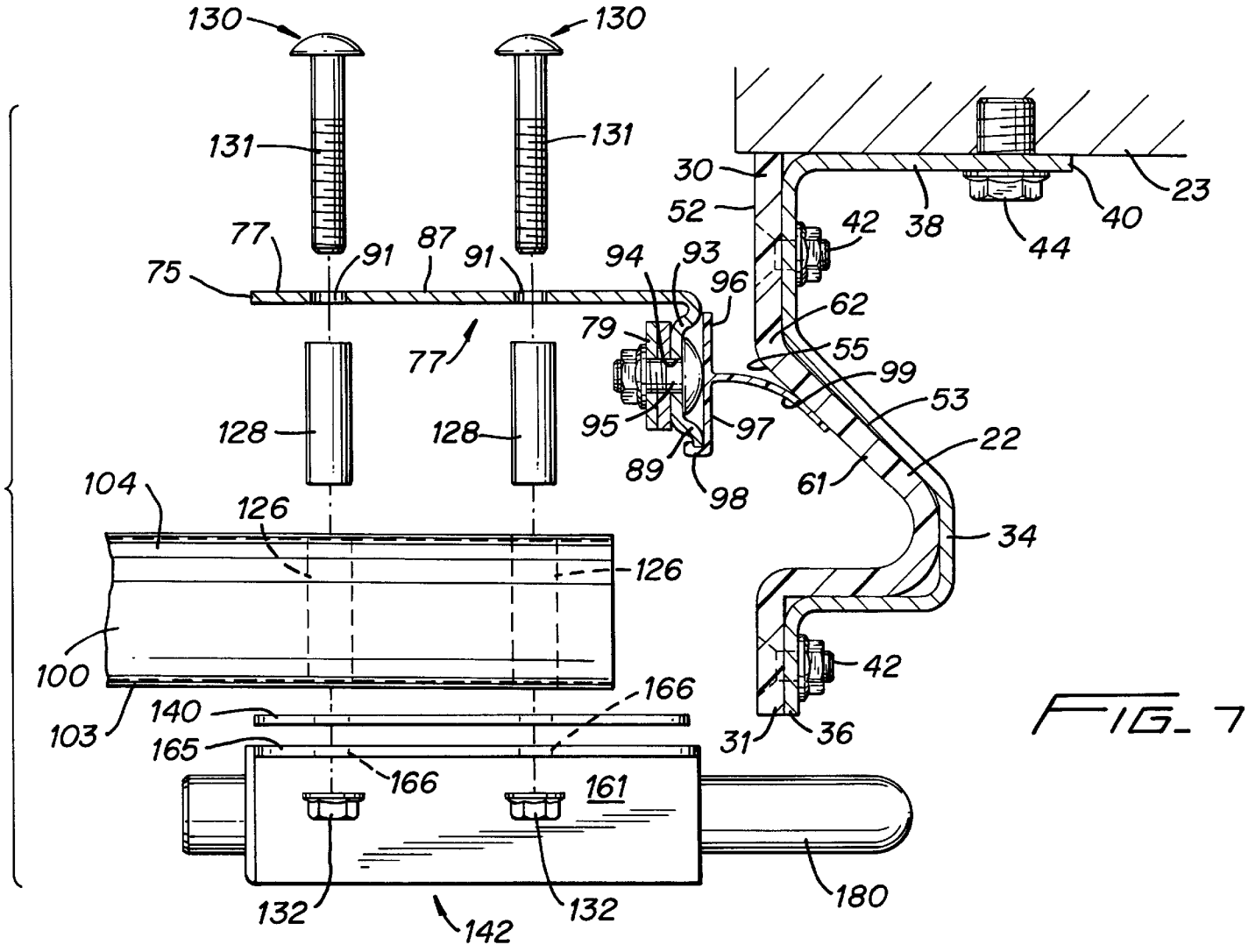
FIG. 7 is a partial, exploded view of the present invention showing how a plunger is mounted to a panel.
Figure 9:
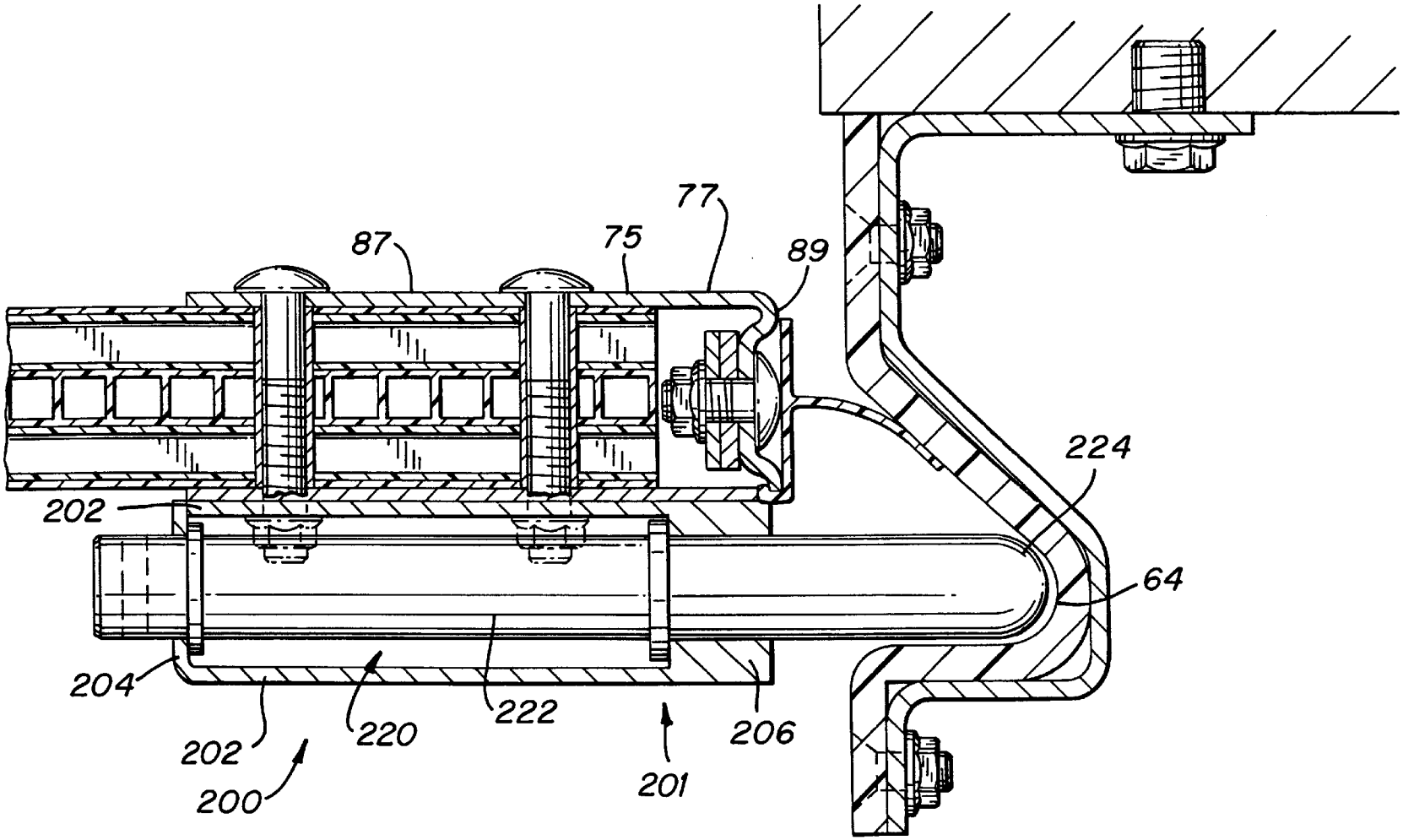
FIG. 9 is a partial cut-away view of a static pin used in an alternative embodiment of the present invention.

As best seen by reference to FIG. 3, each track has a relatively low-friction layer 30 which is preferably made from a polymeric material such as Ultra High Molecular Weight polyethylene and has a coefficient of friction of between 0.15 and 0.25 with respect to steel. The low-friction layer 30 has a first edge 31 and a second edge 33 and is shaped like a script v in cross section. As can be appreciated, low-friction material is generally expensive and, therefore, the low-friction layer 30 is sized so that its dimensions are as small as possible. In order to provide proper rigidity and strength to the tracks 20 and 22, a second, supporting layer 34 is positioned behind the low-friction layer 30. The second, supporting layer 34 has a first edge 36, a leg 38, and a second edge 40. The low-friction layer 30 and second, supporting layer 34 are fixed together by one or more fastners 42 inserted in chamfered bores, as shown in FIGS. 3, 7, and 9. (Although not shown, truss head bores may be provided for the fasteners 42.) Each track may be fixed to a building by a plurality of fasteners 44, inserted through openings in the leg 38 of the second supporting layer 34.

Each track includes inwardly and outwardly facing surfaces 52 and 53, respectively. The inwardly facing surface 52 defines an engagement surface 55 having an angled disengagement portion 61 which continues smoothly to a disengagement point 62. The engagement surface 55 defines a channel 64 which extends along the longitudinal axis of the track and has a center line 66 which is substantially perpendicular to the longitudinal axis of the track. The angled disengagement portion 61 is aligned at an acute angle θ with respect to the centerline 66 of the channel 64.

Each track 20, 22 is operable to release a plunger (discussed below) when force is applied in the direction indicated by the arrow labeled 70. However, the tracks can render the overhead door 10 operable to release in the opposite direction by merely installing the respective tracks in reversed, end-to-end orientation. When so installed, the overhead door is operable to release when force is applied in the direction indicated by the arrow labeled 71. Thus, the present design permits the installer to select the direction of release without requiring additional parts. Further, the individual tracks 20, 22 may have mixed sections, that is, sections which provide for release when struck in one direction when the door is at a first position, and which provide for release in the opposite direction when the overhead door 10 is oriented at a different position above the floor of the building in which it is installed. Of course, if the overhead door 10 is installed in a fashion where the door, when open, is positioned in substantially parallel relation to the floor of the building, the tracks would be oriented such that the weight of the overhead door would not cause the overhead door to release from the its tracks.

The tracks 20, 22 may be shaped in such a manner that the track facilitates release of the overhead door 10 when force of a predetermined magnitude is applied in either of the directions indicated by the arrows 70 and 71. A track so shaped is shown in U.S. Pat. No. 5,535,805, the disclosure of which is hereby incorporated by reference. Modification of the tracks 20 and 22 to function so as to release a door panel upon impact from either of two opposite directions based on the disclosure of U.S. Pat. No. 5,535,805, would be within the knowledge of those skilled in the art.

A panel-carrier frame 75 (FIGS. 2, 3, and 8) having a plurality of pivotally-linked segments 77 is positioned between the two tracks 20, 22. Each segment has a first end 78 with an extension 79 having an aperture (not shown) and, a second end 80 having a receptacle 81 (with two apertures not shown). Each segment 77 may be linked to another by inserting a pin 83 through the apertures in the receptacle 81 and extension 79. The segments 77 are assembled or linked together to form two lateral, substantially parallel supports 85, each of which is aligned with one of the tracks 20, 22.

Figure 2:
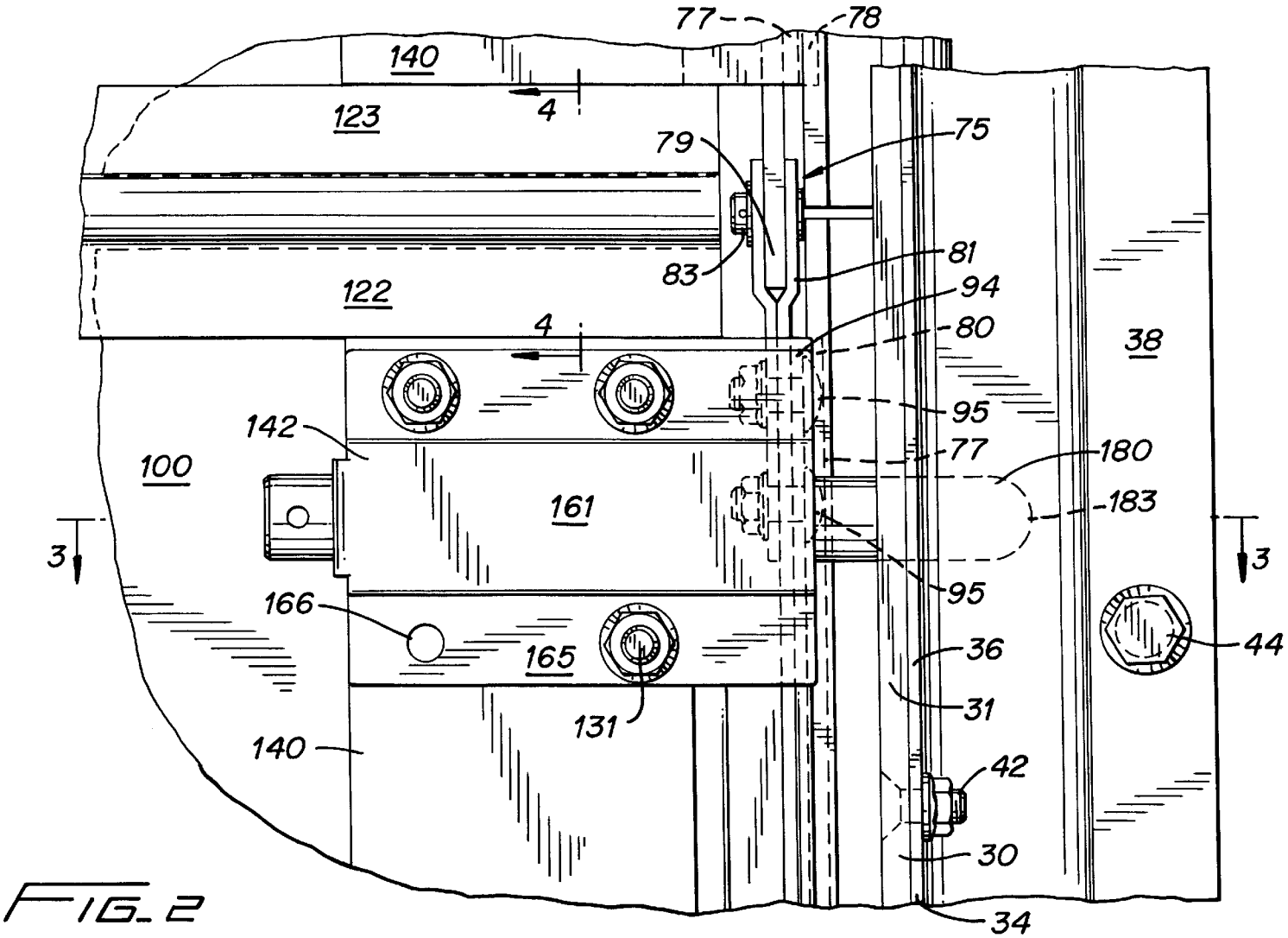
FIG. 2 is a greatly enlarged view of a portion of the door of FIG. 1 showing a plunger used in the present invention.

As can be seen by reference to FIGS. 2, 3, and 7, each segment 77 is L-shaped in cross-section and has a first leg 87 (or portion for being mounted to a panel) and a second leg 89. The first leg 87 has two bores 91. The second leg 89 has an indentation 93 with a plurality of bores 94. One extension 79 is coupled to the first end 78 of each segment 77 by one or more fasteners 95 inserted in one or more of the bores 94 (now shown). Likewise, one receptacle 81 is coupled to the second end 80 of each segment 77 by one or more fasteners 95 inserted in the bores 94.

The panel-carrier frame 75 preferably has at least four segments 77, two on each side but the number of segemnts 77, will vary according to the application at hand. The space between the panel-carrier from 75 and the tracks 20, 22 is blocked by weather-stripping. Specifically, a one-piece solid weather strip 96 snap fits on the second leg 89 of each segment 77. The weather strip 96 has a base section 97 with a leg 98 on one end. A flexible leaf 99 extends from the middle of the base section 97 and is compressed against the surface 55 of each track 20, 22, thereby helping to create a weather-tight seal around the overhead door 10. Preferably, the weather strip 96 is made from PVC (polyvinyl chloride) and is formed by an extrusion process into relatively long pieces.

Figure 8:
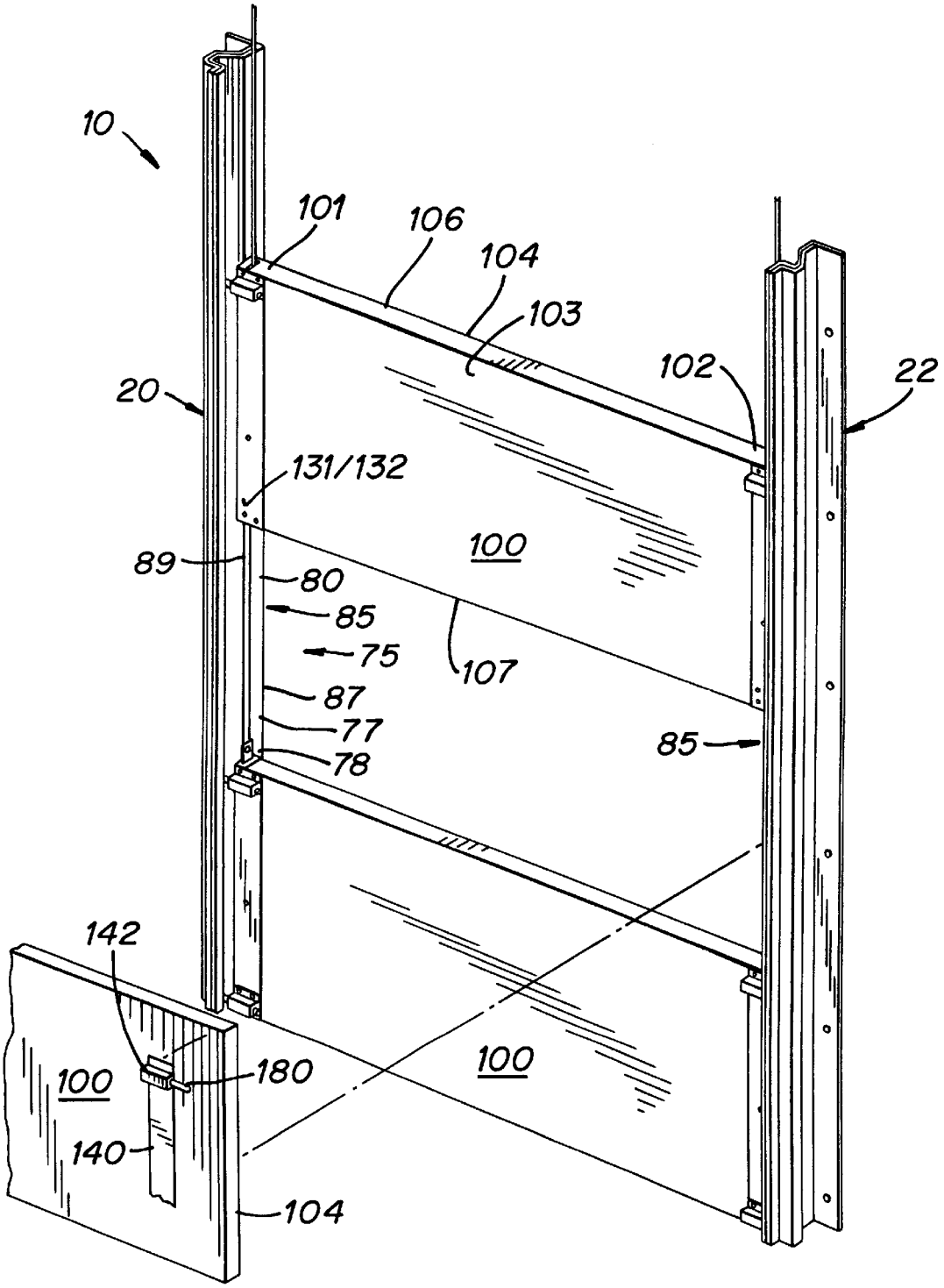
FIG. 8 is a perspective view of the present invention illustrating removal of a panel from the panel-carrier frame of the door.

One or more plastic panels 100 (FIGS. 3 and 8), preferably just one panel 100, are attached to each segment 77 of the panel-carrier from 75. Each panel 100 has a first end 101, a second end 102, an inwardly facing surface 103, an outwardly facing surface 104, a top 106, and a bottom 107. As shown in FIG. 8, the outwardly facing surface 104 of the first end 101, is attached to the leg 87 of one segment 77. Similarly, the outwardly facing surface 104 of the second end 102 is attached to the leg 87 of another segment 77 of the frame 75.

Figure 4:
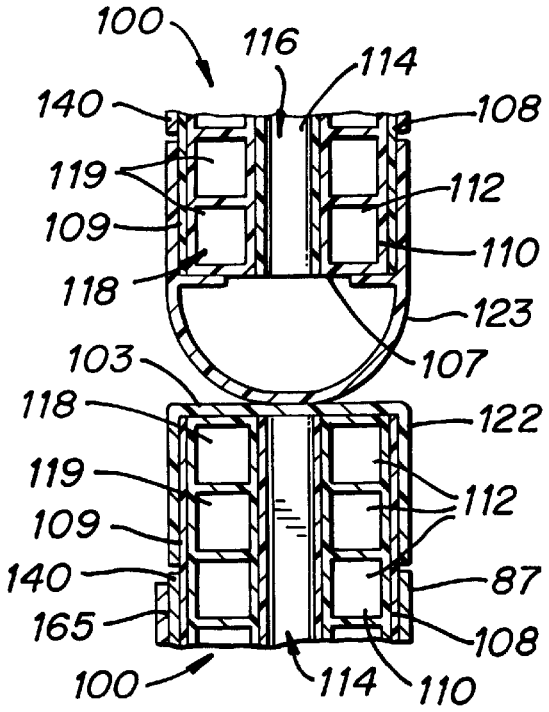
FIG. 4 is a partial, cross-sectional view of two door panels and the seal positioned between them taken along the line 4—4 of FIG. 2.

As best seen by reference to FIGS. 3 and 4, each panel 100 has a multiple-layer construction. In the preferred embodiment, each panel 100 consists of a first outer skin 108 a second inner skin 109, and three, multiple-cell layers positioned therebetween. A first multiple-cell layer 110 is positioned adjacent the outer skin 108 and has a plurality of cells 112 that run along the longitudinal axis of the panel 102. A second layer 114 is positioned adjacent the first multiple-cell layer 110 and has a plurality of cells 116 that are transverse to the longitudinal axis of the panel 100 third multiple-cell layer 118 is positioned between the inner skin 109 and the second layer multiple-cell 114 and has a plurality of cells 119 that run along the longitudinal axis of the panel 100.

Figure 5:
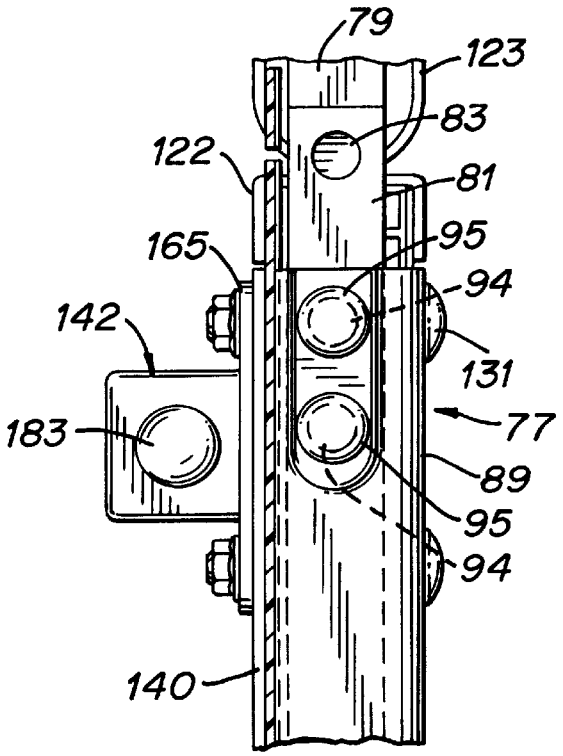
FIG. 5 is a partial, cross-sectional view of the present invention taken along the line 5—5 of FIG. 3.
Figure 6:
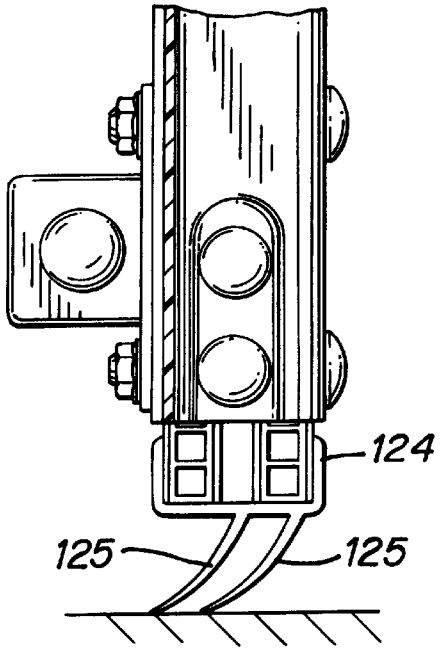
FIG. 6 is a partial, cross-sectional view taken along the line 6—6 of FIG. 3 and shows the weather stripping used on the bottom-most panel of the door of the present invention.

As best seen by reference to FIGS. 4, 5, and 6, cap 122 is fitted on the top 106 of each panel 100 and a flexible, substantially U-shaped seal 123 is fitted on the bottom 107 of each panel 100. The cap 122 and seal 123 form a substantially air and water tight seam between each panel which helps reduce heat and moisture exchange between the inwardly facing and outwardly facing surfaces of the overhead door 100 and, thus, between the interior of the building in which the floor is installed and the environment outside the building. The cap 122 and seal 123 help close the ends of each panel 100 and, in particular, close the cells 116 of the second layer 14.

As can be seen by reference to FIG. 6, the bottom-most panel 100 of the door 10 is fitted with a double-bladed weather strip 124 having two blades 125. Preferably, the weather strip 124 is made from thermoplastic rubber and each of the blades is flexible so as to provide a tight seal between the bottom of the door 10 and the floor of the opening in which the door is installed.

Each of the layers 110, 114, and 118 are substantially identical to one another and a panel 100 may be formed by orienting the layers in a desired fashion and fixing them together with an appropriate adhesive. An adhesive may also be used to fix the outer and inner skins 108 and 109 to the first and third layers 100 and 118. Preferably, the panel is made from a relatively rigid material such as fiberglass. The multiple-layer, multiple-cell construction of the panels provides enhanced rigidity and insulative capability compared to panels of conventional design.

In order to mount the panels 100 to the segments 77, each panel has one or more bores 126 (FIG. 7) which are lined with spacers 128. A fastener 130, such as a bolt 131, is inserted through each bore 91 of the leg 87, through each spacer 128, and secured in place by a nut 132. The bolts 131 and nuts 132 are also used to fix mounting plates 140 and guide assemblies 142 to the inwardly facing surface 103 of each panel 100. As best seen by reference to FIG. 8, if and when one panel 100 becomes damaged it may be removed from the panel-carrier from 75 by loosening the nuts 132 and removing the bolts 131 from the panel of interest. With the nuts 132 and bolts 131 removed, the mounting plates 140 and guide assemblies 142 can be removed from the panel of interest and the panel may be removed from the panel-carrier frame 75. Importantly, the other panels in the door 100 are held in position by the panel-carrier frame 75, spaced apart from one another, and engaged in the tracks 20, 22. Thus, a new panel may be bolted in place of the damaged one without requiring that the entire door be disassembled or removed from the tracks.

Each guide assembly 142 holds a single plunger 180 (discussed below) and along with the tracks 20, 22 are important elements in providing the overhead door with the capability to release, upon exposure to force of a predetermined magnitude, from the tracks. Each panel 100 has at least a pair of assemblies 142 and each assembly 142 is mounted on one mounting plate 140 in close proximity to either the first end 101 or the second end 102. While a pair of assemblies is shown mounted on each panel 100 in the drawings, it will be recognized that four guide assemblies may be used in some applications due, in part, to the size of the door panel employed.

The individual guide assemblies include a housing 161 (FIGS. 3 and 4) which is defined by side walls 162. The housing further includes a front wall 163 and a rear wall 164 which are disposed in predetermined substantially parallel, spaced relation one to the other. A flange 165 is made integral with the housing 161 and further includes a plurality of apertures 166 positioned in a predetermined pattern and which accommodate individual fasteners 130 (e.g. bolts 131) to secure each housing 161 to the underlying door panel 100. The fasteners 130 may be manufactured from a frangible material which will shatter or otherwise break when exposed to a shearing force of a predetermined magnitude. When so designed, the fasteners 130 provide additional safety against damage to the overhead door 10 when, for whatever reason, the plungers do not release from the tracks 20, 22.

The housing 161 also has a apeture 169 formed in the rear wall 164. Additionally, a front aperture 171 is defined by the front wall 163. Enclosed within each housing 161 is a plunger 180. The plunger 180 has a shaft 182 received in the apertures 169 and 171 with a head 183, a rear end 184, and a stop 185. A biasing means, preferably a spring 187, is biased between the front wall 163 and the stop 185 and biases the head 183 of the plunger 180 at a position 188.

In the position 188, the head 183 engages the track 20 or 22, depending on which end of the panel the guide assembly 142 is mounted. The plunger 180 is reciprocally moveable along a predetermined path of travel 190 between the first, engaged or extended position 188, as shown in FIG. 3, where it is received in the channel 64, to a second, depressed or releasing position 192, shown in phantom lines in FIG. 3. In the second position 192, the plunger assembly is urged backwardly against the force of the biasing spring 187. When moving toward the second position 192, the plunger 180 is also urged along the engagement surface 55 following the application of force of a predetermined magnitude to the door panel 100. The plunger is specifically designed to react to force that acts in a plane that is substantially perpendicular to the door panels. When the force is of sufficient magnitude, the plunger 180 is forced rearwardly until the door panel 100 is released from the track 20, 22, or both, thereby avoiding damage to the overhead door 10, the tracks 20, 22 or any surrounding assemblies or structures. To reset the overhead door in the respective tracks 40, an individual merely grasps the rear end 184 of the shaft 182 and pulls it rearwardly, thereby permitting the plunger 180 to be moved into engagement with the u-shaped channel 64. Biasing springs of different strengths can be selected to adjust the door to release at any one of many desired levels of force.

While it is preferable that the plungers 180 be operable to release from the tracks 20, 22, in some circumstances the need for a releasable or breakaway door does not exceed the cost associated with providing the release mechanisms. Further, since the panel-carrier frame 75 permits the repair and replacement of individual panels without the need to remove the entire door 10 from the tracks 20, 22, having a door with releasable panels may not be necessary in many applications. Damage may be fixed by merely replacing a panel. Accordingly, a lower cost embodiment of the present invention may be constructed by replacing the guide assemblies 142 with guide assemblies 200 (FIG. 9). Like the guide assemblies 142, each guide assembly 200 has a housing 201 with two side walls 202, a front wall 204, a rear wall 206, and a flange (not shown). The flange includes a plurality of apertures (also not shown) which are positioned in a predetermined pattern and accommodate individual fasteners 130 (bolts 131) to secure each guide assembly 200 to the underlying door panel 100.

Within the housing 201 is a static plunger or pin 200. The pin 220 has a shaft 222 (which is fixed in the front and rear walls 204 and 206) with ahead 224. The pin 220 is positioned so that the head 224 extends outwardly from the rear wall 206 and, when the guide assembly 200 is mounted on a door panel, rides in the channel 64 of one of the tracks 20, 22. Since the pin 220 is fixed in position, it will not release from its tracks when the door 10 is impacted. However, if the door panels 100 are damaged during an impact, the panels 100 may be removed from the panel-carrier frame 75 and replaced, as was described above.

As is evident from the description above, the present invention may take the form of one of two embodiments. However, other modifications to various components may be made and would be apparent to those skilled in the art. Thus, while the present invention has been described in what is believed to be the most preferred forms, it is to be understood that the invention is not confined to the particular construction and arrangement of the components herein illustrated and described, but embraces such modified forms thereof as come within the scope of the appended claims.

What is claimed is:

1. An overhead door for a structure, the door comprising:

two tracks capable of being mounted on the structure, each track having a surface with a channel;

a panel-carrier frame having a plurality of segments pivotally-linked to each other;

a plurality of relatively rigid door panels, each door panel mounted on a segment of the panel-carrier frame, and having first and second ends and inwardly and outwardly facing surfaces; and a plunger borne by each door panel, and positioned adjacent the first and second ends of the inwardly facing surface of each door panel, each plunger having a first end biased in a first position within the channel of one of the tracks.

2. A door as claimed in claim 1, wherein the surface of the track is composed of relatively low-friction material.

3. A door as claimed in claim 2, wherein each track includes a first layer and a second layer, and the first layer is composed of the relatively low-friction material.

4. A door as claimed in claim 3, wherein the first and second layers of each track are fastened to each other periodically along their lengths.

5. A door as claimed in claim 3, wherein the first layer of the track is composed of polyethylene and the second layer of the track is composed of steel.

6. A door as claimed in claim 1, wherein each panel includes multiple, parallel layers of cells.

7. A door a claimed in claim 1, wherein each track has an angled disengagement portion continuing smoothly to a disengagement point each plunger is reciprocally moveable along a predetermined linear path of travel within the channel of the track between a first, engaged position where the first end of each plunger is received in one of the channels of the track, and a second retracted position where the first end of the plunger is displaced from said channel, and one or more plungers will move along the angled disengagement portion of the track to disengage from the track when a force of a predetermined magnitude acting substantially perpendicularly to one of the panels is applied to the door.

8. A door as claimed in claim 1, wherein each panel has a first plate mounted on the inwardly facing surface near the first end of the panel and a second plate mounted on the inwardly facing surface near the second end of the panel.

9. A door as claimed in claim 8, wherein each panel includes four plungers, with two of the plungers mounted on the first plate and two of the plungers mounted on the second plate.

10. A door as claimed in claim 8, wherein each panel includes two plungers, with one plunger mounted on the first plate and a second plunger is mounted on the second plate.

11. A door a claimed in claim 1, further comprising a single-piece, solid weather strip coupled on each end of each panel and adapted for being in contact with the surface of one of the tracks.

12. An overhead door for a structure, the door comprising:

two tracks capable of being mounted on the structure, each track having a length, and a first relatively low-friction layer with a channel and a second layer;

a panel-carrier frame having a plurality of segments pivotally-linked to each other;

a plurality of multiple-layer, plastic door panels, each door panel mounted on a segment of the panel-carrier frame, and having first and second ends, a top and bottom, and inwardly and outwardly facing surfaces;

means for mounting a plunger positioned on the first and second ends of the inwardly facing surface of each door panel;

one or more plungers positioned on each plunger mounting means, and each plunger having a first end biased in a first position within the channel of one of the tracks; and a single-piece, solid weather strip coupled on each end of each panel and adapted for being in contact with the first layer of one of the tracks.

13. A door as claimed in claim 12, wherein the first layer of the track is composed of polyethylene and the second layer of the track is composed of steel.

14. A door as claimed in claim 13, wherein the first and second layers of each track are fastened to each other periodically along the length of the track.

15. A door as claimed in claim 12, wherein each panel has a c-shaped cap on its top and a u-shaped seal on its bottom.

16. A door as claimed in claim 12, wherein each panel includes multiple parallel layers of cells.

17. A door as claimed in claim 12, wherein each track has an angled disengagement portion continuing smoothly to a disengagement point, each plunger is reciprocally moveable along a predetermined linear path of travel within the channel of the track between a first, engaged position where the first end of each plunger is received in one of the channels of the track, and a second retracted position where the first end of the plunger is displaced from one of the channels of the track, and one or more plungers will move along the angled disengagement portion of the track to disengage from the track when a force of a predetermined magnitude acting substantially perpendicularly to one of the panels is applied to the door.

18. A door as claimed in claim 12, wherein each panel has a first plate mounted on the inwardly facing surface near the first end of the panel and a second plate mounted on the inwardly facing surface near the second end of the panel.

19. A door as claimed in claim 18, wherein each panel includes four plungers, with two of the plungers mounted on the first plate and two of the plungers mounted on the second plate.

20. A door as claimed in claim 12, wherein the weather strip is composed of a polymeric material.

21. An overhead door for a structure, the door comprising:

two tracks each having a channel;

a panel-carrier frame having a plurality of pivotally-lined segments;

a plurality of door panels, each door panel removeably mounted on one of the pivotally-linked segments of the panel-carrier frame, each door panel having first and second ends;

at least one guide assembly borne by the first end of each panel;

at least one guide assembly borne by the second end of each panel; and each guide assembly having a pin for being positioned within the channel of one of the tracks.

22. An overhead door as in claim 21, wherein each track includes a low-friction surface.

23. An overhead door as in claim 21, wherein each pin is fixed in a static position.

24. An overhead door as in claim 21, wherein each pin is reciprocally moveable along a predetermined linear path of travel between a first position and a second retracted position.

* * * * *